US006033499A

United States Patent [19]

Mitra

[11] Patent Number: 6,033,499

[45] Date of Patent: Mar. 7, 2000

[54] PROCESS FOR STRETCH FORMING AGE-HARDENED ALUMINUM ALLOY SHEETS

[75] Inventor: Rana Mitra, Warren, Mich.

[73] Assignee: General Motors Corporation, Detroit, Mich.

[21] Appl. No.: 09/168,615

[22] Filed: Oct. 9, 1998

[51] Int. Cl.[7] ..... C22F 1/04

[52] U.S. Cl. ..... 148/688; 148/691; 148/698; 148/695; 72/342.1

[58] Field of Search ..... 148/688, 691, 148/698, 695; 72/342.1, 342.5, 342.6, 342.94

[56] References Cited

U.S. PATENT DOCUMENTS

| | | | |
|---|---|---|---|
| 3,856,584 | 12/1974 | Cina | 148/159 |
| 4,077,813 | 3/1978 | Fletcher et al. | 148/12.7 A |
| 4,082,578 | 4/1978 | Evancho et al. | 148/12.7 A |
| 4,405,386 | 9/1983 | Mravic et al. | 148/11.5 A |
| 4,766,664 | 8/1988 | Benedyk | 29/512 |
| 4,885,927 | 12/1989 | Corkin et al. | 72/342 |
| 5,458,393 | 10/1995 | Benedyk | 296/203 |
| 5,911,844 | 6/1999 | Benedyk | 148/688 |
| 5,948,185 | 9/1999 | Krajewski et al. | 148/698 |

*Primary Examiner*—George Wyszomierski
*Assistant Examiner*—Janelle Morillo
*Attorney, Agent, or Firm*—George A. Grove

[57] ABSTRACT

In the stretch forming of aluminum alloys using a punch and a mating die cavity, the stretch formability of a sheet of age-hardened aluminum alloy is increased by selectively heat treating the sheet to soften at least a portion of the sheet that will underlie a punch surface but not be drawn over a radius of the punch.

9 Claims, 2 Drawing Sheets

PROCESS FOR STRETCH FORMING AGE-HARDENED ALUMINUM ALLOY SHEETS

TECHNICAL FIELD

This invention relates to the stamping of age-hardened aluminum alloy sheets to form articles of manufacture such as automobile body panels. More specifically, this invention relates to the stretch forming of such sheets.

BACKGROUND OF THE INVENTION

A principal limitation of any sheet metal stamping process is the creation of an inhomogeneous deformation pattern (i.e., strain distribution pattern) across the sheet. Large, relatively flat regions of the panel may undergo little or no deformation, while areas with complex shapes and sharp features become heavily deformed and thereby work hardened. The amount of useful deformation that can be applied to the panel as a whole is thus limited by tearing failure (fracture) in those heavily worked regions, since they become incapable of withstanding any further deformation.

The stamping industry and academia have long struggled with this problem of inhomogeneous deformation patterns which limit the formability of a sheet. Many different approaches have been devised with the intention of minimizing the problem, since it cannot be totally eliminated. These include development of sheet metals with improved formability, use of lubricants which reduce friction between the sheet and the dies, improvements in die materials and finishes, improved die design methods, etc. All of these, however, have specifically focused on the problem areas themselves, viz. the heavily deformed localized regions which ultimately fail by tearing.

SUMMARY OF THE INVENTION

This invention provides a method of stretch forming age-hardened aluminum alloy sheets to markedly improve stretch formability. The method is applied to the so-called "non-problem" areas of the blank, which have traditionally been excluded from consideration. In the case of a stretch forming operation, for example, such an area is that region of the sheet underlying the punch that is not intended to be stretched over the radius of the punch. The invention achieves this objective by selectively altering the mechanical properties in these non-traditional regions. The selection of these locations and their dimensions will depend on many factors, but most importantly on panel and die geometries, which vary from one panel to another.

With aluminum alloy 6111 and similar sheet metal, the most straightforward way of altering local properties is by a suitable softening (retrogressive) heat treatment applied to selected regions of the as-received blank.

Aluminum alloy 6111 in T4 temper was developed specifically for stamping automobile body panels. Its usage is continually increasing, driven by the necessity for reducing vehicle weight. However, it is less formable than the traditionally used low carbon steels. It is an age-hardening (precipitation hardening) aluminum alloy with a nominal composition of, by weight, 0.75% magnesium, 0.90% silicon, 0.70% copper, 0.30% manganese, 0.10% chromium and 0.15% zinc. It is supplied to the stamping plant in the T4 condition, which consists of solution heat treating at final gauge at a temperature above 530° C. for a predetermined amount of time, followed by quenching and then naturally aging (i.e., aging at room temperature) for at least a week for it to reach essentially the T4 level of strength and hardness. A typical yield strength for an aluminum 6111-T4 alloy is 178 MPa.

It is widely known that when age-hardening alloys such as 6111 aluminum with a certain temper (e.g., T4 or T6) are heated to a temperature at or below the solutionizing temperature, complex precipitates in the metal are wholly/partially dissolved into solid solution. When the heated alloy is rapidly quenched to room temperature, these dissolved precipitates are unable to immediately precipitate back, and temporarily remain in a supersaturated state in the solid solution. With time, however, they are able to precipitate to their original condition. The extent and nature of this whole process is quite complicated and varies with the alloy composition, heating temperature, time at temperature, cooling rate, etc.

In terms of mechanical properties, the flow strength of the alloy temporarily decreases from its tempered value (e.g., 178 MPa), so long as the precipitates remain partially or fully dissolved in supersaturated solid solution at room temperature. The invention utilizes this fact in order to lower the flow strength in selected regions of the blank before it is stretch formed. Thus, for a temporary period following the treatment (usually a few hours), these treated areas of the blank remain more deformable than the untreated areas which remain unchanged at their T4 strength level.

In a typical stretch forming operation, the edges of a sheet of an age-hardened aluminum alloy are clamped in a fixed position (such as over a die cavity) and the sheet is stretched using a punch. The punch has a sheet forming surface and a radius at the periphery of the punch. As the punch is moved into engagement with the sheet, the sheet is stretched across the forming surfaces of the punch, and some of the sheet material is stretched around the radius of the punch. Depending upon the shape to be formed by the stretching operation, some part of the sheet remains under the punch forming surface and is not drawn around the punch radius. It is that portion of the original sheet blank not drawn around the punch radius that is subjected to the heat treatment step of this invention.

The method of this invention applies this treatment before the stretch forming operation by rapidly heating the above-described region(s) of the blank in a range above the aging temperature (~250° C.) but below the solution treatment temperature (~530° C.), followed by rapid quenching (e.g., in cold water). Since the sheet thickness is only of the order of 1 mm (e.g., 0.7 to 1.2 mm), it takes less than 10 seconds for it to reach temperature, and it is also easily quenched. The reduction in flow strength achieved depends primarily on the treatment temperature and on the quench rate. As stated above, this is only a temporary condition. If the material is left at room temperature, it will regain its original temper in approximately a week.

The basic principle underlying this type of thermal treatment for age-hardening alloys has been used by different investigators for various purposes. A process known as retrogression and re-aging (RRA) was first applied to the 7XXX series aluminum alloys used in aircraft structures, in order to reduce the susceptibility of these alloys to stress corrosion cracking, by Baruch M. Cina of Israel Aircraft Industries Ltd. in 1974 (U.S. Pat. No. 3,856,584). It was later improved upon by a number of other investigators, mostly from ALCOA. Another similar heat treatment process (called retrogression heat treatment or RHT) was used by ALUMAX Inc. for enhancing the fabricability of 6061 aluminum in T4 and T6 conditions used in structural members such as chassis and spaceframe components (see U.S. Pat. Nos. 4,766,664 and 5,458,393). However, none of these methods were used to solve the problems encountered in the stretch forming of sheet metal in stamping dies, which is the objective of this invention.

DESCRIPTION OF PREFERRED EMBODIMENTS

Typical sheet metal stamping processes are characterized by two fundamentally different macroscopic deformation mechanisms in the sheet itself which may occur either separately or in some combination depending upon the panel geometry. These are (i) pure stretching and (ii) deep drawing. In industrial stamping practice, particularly in the automotive stamping industry where complex shapes are involved, the stamping process usually employs a combination of the two types of deformation to manufacture a panel.

The stretching or stretch forming operation consists of clamping, and locking in place, a sheet metal blank around its periphery and then stretching the central region into a die cavity with a punch in order to achieve the desired shape. The process always develops inhomogeneous deformation patterns within the stretched blank. Depending upon die geometry, many different types of patterns can be obtained.

The geometry of a part most often formed in stamping automobile body panels, such as hood and roof outer panels, consists of large, relatively flat central areas surrounded by regions of sharp curvature across the punch radii into the stretched wall. This is shown schematically in FIGS. 1A through 1D in a greatly reduced scale.

Figure 1A:
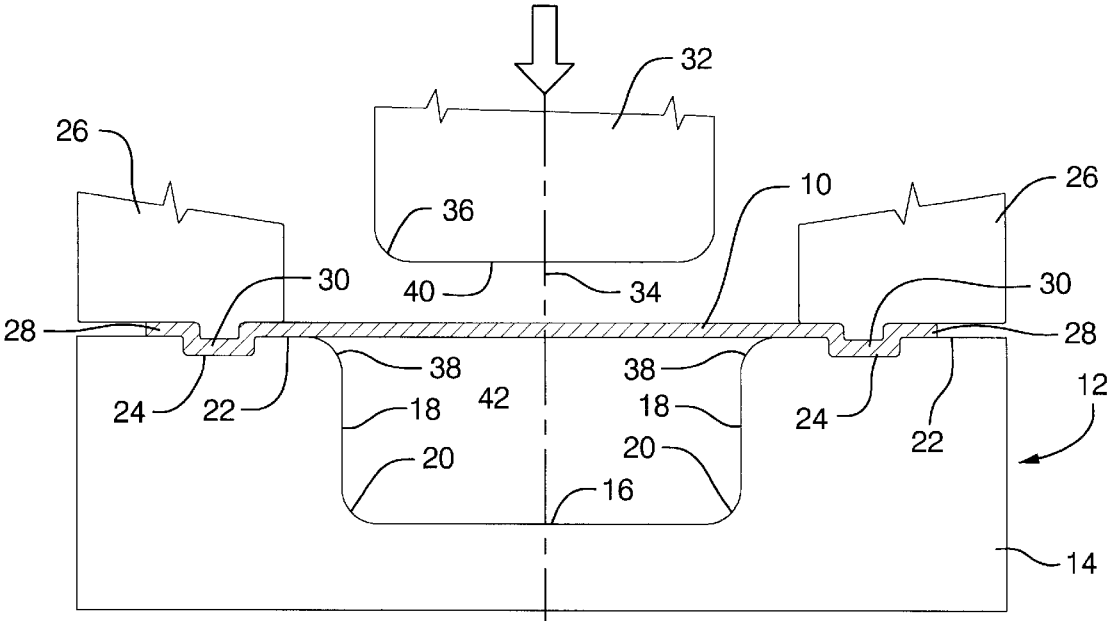
FIGS. 1A, 1B, 1C, and 1D are schematic views, partly in section and partly broken away, showing four steps in the stretch forming of an aluminum alloy sheet using a die and punch.

FIG. 1A is a sectional view illustrating a sheet 10 of an age-hardened aluminum alloy (e.g., alloy 6111, T4) locked in position on a die member 12. Die member 12 includes a die cavity portion 14. For purposes of illustration, die 12 is presumed to have a symmetrical die cavity about the center line 34 and defining a pan-like structure determined by a flat bottom portion 16 of the die and straight walls 18. Obviously, the pan could be in the overall shape of a hood or roof panel. Walls 18 merge with bottom portion 16 in a radius portion 20. Die 12 has an upper surface 22 that is peripheral to cavity walls 18. A binder ring portion works in combination with die binder member 26 to deform and grip the peripheral edges 28 of sheet 10 in lockbeads 30. Thus, the peripheral edges 28 of sheet 10 are securely anchored between the die binder member 26 and the die member 12 itself. Punch 32 is activated in the direction of the arrow by a press mechanism (not shown) to engage sheet 10 in a stretch forming operation. Since the exemplary die member 12 as depicted defines a symmetrical die cavity, FIGS. 1B, IC and 1D only show the portions to the left of center line 34 of the die 12.

Figure 1B:
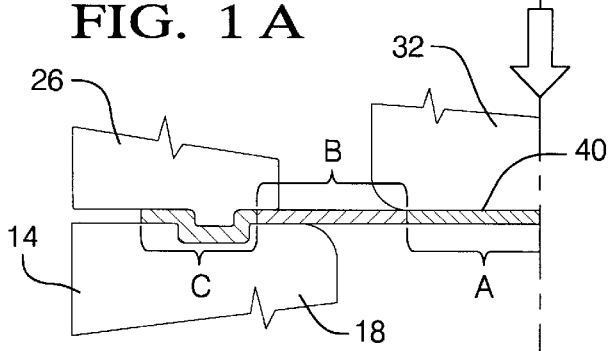
Figure 1C:
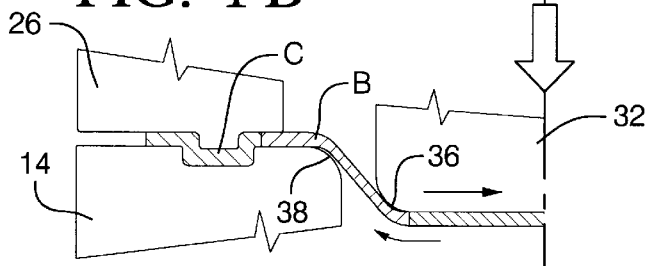
Figure 1D:
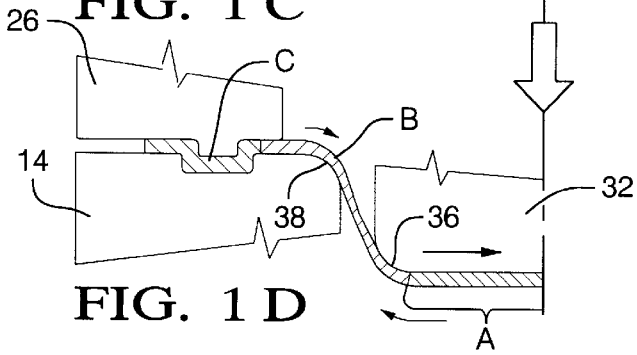

The punch 32 has a punch radius ($R_p$) at 36. Die 12 also has a radius 38, $R_d$, where die cavity wall 18 merges with upper peripheral surface 22. Referring to FIGS. 1B, 1C and ID, aspects of the practice of this invention in connection with the stretch forming of sheet 10 is further illustrated. Sheet member 10 has regions respectively characterized in FIG. 1B as region A, region B and region C which are of significance in describing the forming process on the sheet.

As seen in FIG. 1B, region A is the portion of sheet 10 that underlies the punch surface 40 (to the left of center line 34) as it just engages the sheet. Region B of sheet 10 is the portion between region A and the lockbead 30 portion, region C, of sheet 10.

Region C is the outer periphery 28 of the blank 10. It is clamped in place between die surface 22 and binder member 26 by lockbeads 30 so that there is no metal movement from region C into the die cavity 42 (walls 16 and 18) throughout the stretch forming operation. The necessary shape change therefore comes from stretching the other regions (A and B) of the blank 10 by the punch 32.

As punch 32 progresses into the die cavity 42, it pulls sheet 10 material in region B (see FIGS 1C and 1D) over the punch profile radius $R_p$ (36) and die radius 38 into what becomes the stretched wall region B of sheet 10 as it is formed. As sheet 10 is formed, the material in region A is pulled by region B material across the face 40 of punch 32 toward punch radius 36. The material of sheet 10 in region B is thinned by bending and unbending as it is stretched over die radius 38 and punch radius 36, and consequently becomes weaker. Concurrently, a frictional resistance (→) develops over $R_p$ which opposes this movement (←). With continued deformation, a stage is eventually reached when the weak, thinned material in region B can no longer support the frictional resistance and fails by tearing. This marks the end of the stretching operation.

In a typical stamping operation involving stretch forming, the radius $R_p$ at 36 is small so that the thinning of region B under bending and the frictional resistance can both be quite severe. This restricts the stretching of region A over punch face 40, so that it remains negligibly deformed while region B fails due to severe deformation. The resulting inhomogeneity in deformation pattern across the formed panel is quite severe. Conventional approaches to reducing this problem and increasing stretchability include using more formable sheet metal grades, making radius $R_p$ as large as possible, and using improved lubricants to reduce friction. In effect, the focus is on problem areas $R_p$ and region B and not on region A, the layer under punch 32 and inside punch radius 36, which is negligibly deformed.

This invention departs from conventional practice by focusing on the region A. With age-hardened aluminum alloys such as 6111-T4, region A is "softened" by selectively lowering its flow strength compared to the rest of the blank. This is achieved by applying to this region the thermal treatment described below. Thus, it will be comparatively easier for the thinned (and therefore weaker) material in region B (FIG. 1) to stretch more of the relatively softer material in region A over punch face 40 toward $R_p$ and toward the die wall 18, before exceeding its own pulling capacity. The amount of additional stretching which can be realized by this method will depend on the extent of local "softening" in region A which, in turn, will depend on the sheet metal grade, the thermal treatment schedule followed, and the exact location and dimensions of the treated region.

It is understood that the benefit of subjecting region A of sheet 10 to the softening heat treatment is that the stress required to stretch and deform region A is thereby substantially reduced. Accordingly, region B of the sheet which is acting to draw region A metal can pull region A metal with less stress. Thus, region B will be capable of pulling more material from region A toward the wall region 18 of the die before region B reaches its yield limit. This results in two significant benefits: (i) deeper and more complex shapes can be stretched than are currently feasible, and (ii) the deformation pattern across the stretch formed panel is more homogeneous, resulting in improved strength and dent resistance.

Experimental

Figure 2A:
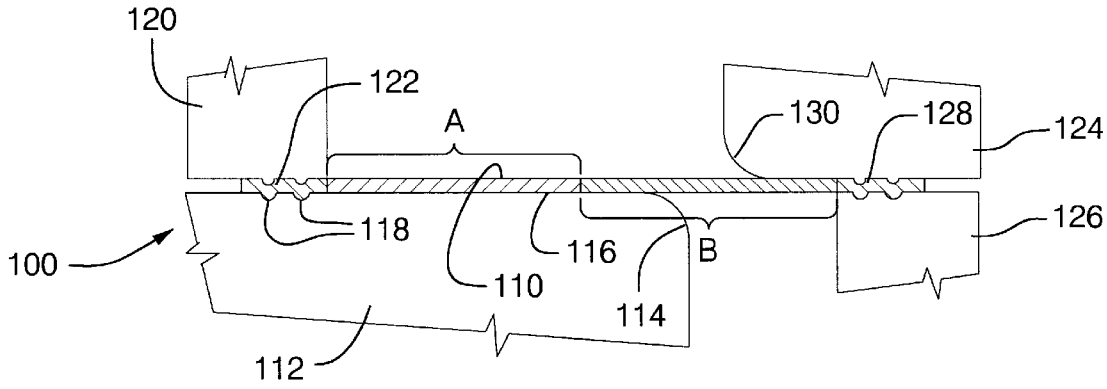
FIGS. 2A and 2B are schematic views, partly in section, showing two steps in the stretch forming of an aluminum alloy sheet using a simulator test apparatus.
Figure 2B:
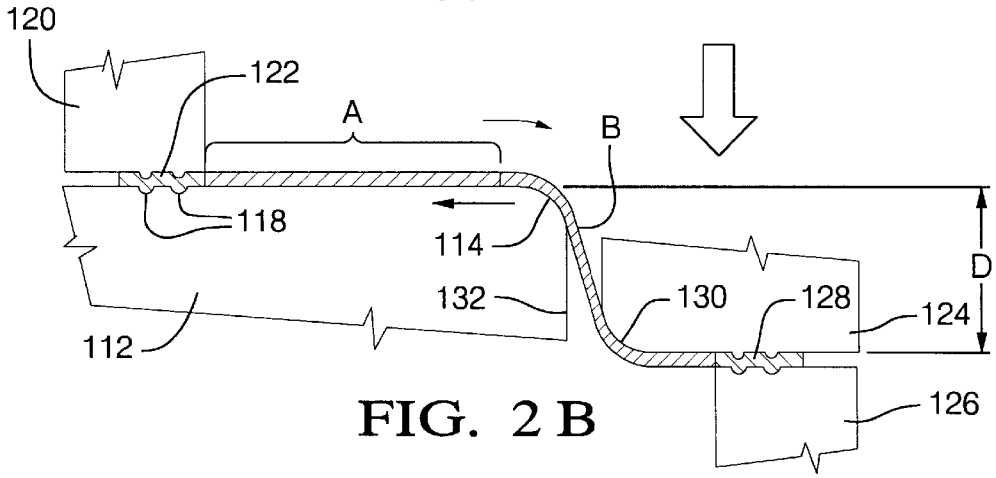

FIGS. 2A and 2B illustrate a stretch form simulator 100 that was used in evaluating the process which is this invention. In FIGS. 2A and 2B, the age-hardened (T4) aluminum 6111 alloy sheet is indicated at 110. In this stretch form simulator 100, a fixed punch 112 with punch radius 114 and punch surface 116 is employed. The fixed punch has locking slots 118. A binder member 120 is used in combination with the fixed punch 112 to deform and anchor sheet 110 as indicated at the lockbead portions 122. Similarly, the other end of the test specimen age-hardened aluminum sheet is anchored at a lockbead portion 128 on moving die 124 and under member 126. Moving die 124 has a die radius 130.

First Test Series

Figure 3A:
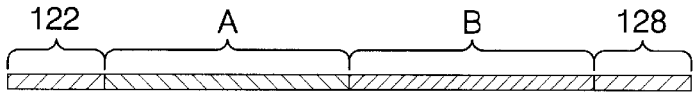
FIGS. 3A and 3B show side views of a stretch form simulator test specimen before and after a stretch form test.
Figure 3B:
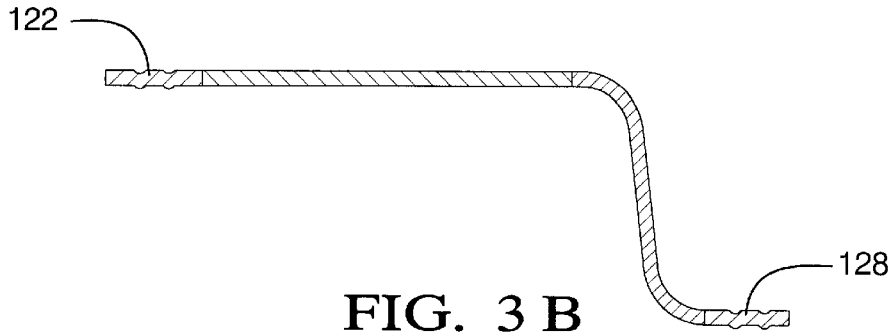

Sheets of 6111-T4 aluminum alloy, 1067 mm long and 152 mm wide, with nominal thickness of 0.7 mm, were tested in the Stretch Form Simulator. A schematic of the test geometry is shown in FIGS. 3A and 3B. The rectangular sheet 110 was clamped with lockbeads 122, 128 at its ends with a length of 897.3 mm of sheet material between the lockbead regions 122 and 128. The sheet was stretched over die radius 130 (6 mm) and over a punch radius 114, which was set at 6 mm for this test. In this test, sheet 110 failure typically occurs by tearing either at the "wall" 132 between punch radius 114 and die radius 130 or at the lockbeads 122, 128. The distance (D, FIG. 2B) between the punch surface 116 and the die surface at failure is taken as the maximum achievable depth for a given condition. Standard lubrication (RP-4105A) was used. All testing was conducted with the tools and test strips at room temperature.

The first phase of the program consisted in testing several specimens in the as-received, i.e., T4, condition. A first T4 specimen was stretched to a depth D of 25.4 mm without failure. A second specimen was stretched to the same depth, D, without failure. Subsequent specimens were stretched. Stretch depth (D) was increased from 25.4 mm onwards, in 6.35 mm increments. Two specimens were tested at each depth. Eventually, failure occurred by tearing in the lockbead region 128 (FIG. 2B) in the specimens which were stretched to a depth of 57.2 mm. A few additional tests were done at this depth and at the previous depth of 50.8 mm where no failure occurred. Thus, under the test conditions, the maximum attainable depth, D, with conventional stretching of 6111-T4 aluminum alloy (yield strength 178 MPa) was between 50.8 and 57.2 mm.

In the second phase of these first tests, the method of this invention was used to lower the flow strength in a localized region (region A, FIG. 2A) of the test specimens. The location of the selected area, region A, is shown schematically in FIG. 3A. The heated and quenched region was across the width of the sheet for a distance of 610 mm from drawbead region 122. A temperature of 450±5° C. was used in the tests. Because of their small thickness and high thermal conductivity, the sheets took about five seconds to reach the operating temperature before they were quenched.

A heating fixture was designed and built for the tests. The as-received flat sheet specimen was clamped and heated between matching upper/lower pairs of electrically-heated blocks. Each block was separately heated by electric cartridge heaters housed in them. A control panel allowed the temperature of each block to be set independently. A clamping/unclamping mechanism was pneumatically operated. The blocks were each 203 mm (8 in) wide and 50.8 mm (2 in) thick, but varied in length from 76.2 to 305 mm (3 to 12 in). This modular design allowed for different heating configurations, where the heated zone for a specimen could be varied in length from a minimum of ~76 mm (3 in) to a maximum of ~610 mm (24 in) simply by adding or removing any given pair of blocks. Furthermore, since each block could be heated independently, a thermal gradient could be created in the sheet by heating different blocks to different temperatures.

Several identical 6111-T4 aluminum sheet specimens were heated in region A (610 mm length) as depicted in FIG. 3A. Region A of each specimen was heated to and at 450° C. for five seconds and then quenched in water.

As with the as-received specimens, a separate heat treated sheet was used to increase the stretch depth in 6.35 mm increments. Failure first occurred in a specimen which was stretched to a depth D of 114.3 mm. Several additional specimens were tested at this depth and at the previous depth of 108 mm where no failure was observed. Thus, using an embodiment of the proposed method, the maximum allowable depth was increased to between 108 and 114 mm, which is more than double the depth (between no failure at 50.8 and repeated failure at 57.2 mm) reached in testing of the 6111-T4 sheets.

This embodiment of this invention thus increased the stretchability of 6111-T4 aluminum by approximately 110%. By changing the test parameters, such as die geometry, treatment temperatures, thermal gradients within the selected area, dimensions of the selected area, etc., the method can realize a wide range of improvements for a variety of different stretching requirements.

Second Test Series

Additional 6111-T4 aluminum alloy sheet of one millimeter nominal thickness was obtained. Specimens were prepared, rectangular in shape, having a length between drawbead regions of 897.3 mm and a width of 152 mm. Then a section (region A, FIG. 3A) 508 mm in length beginning at the punch lockbead section 122 was heat treated at 315° C. for five seconds and then quenched. A number of like sized specimens were prepared in the as-received age-hardened condition. The yield strength of the as-received specimens was nominally 178 MPa. The heat treated specimens had a yield strength in the heat treated region of about 124.6 MPa or about 70% of the as received yield strength. Obviously, in these second test series treated specimens of greater thicknesses, a shorter region was heat treated and to a lower heat treatment temperature.

In the first subseries of these tests, a punch radius (114) of six millimeters was employed. Initially, a series of experiments was conducted like those described above (First Test Series) where increasingly severe stretching was carried out. In the as-received one millimeter thick 6111-T4 aluminum alloy specimens with the six millimeter punch radius, a maximum stretch depth D (as depicted in FIG. 3) without failure of 67 mm was obtained. When the heat treated specimens were then subjected to the same series of tests with increasingly severe draw strains, a maximum stretch depth without failure of 95 mm was obtained. This amounted to a 42% increase in the draw depth D between the as-received specimens and the specimens treated in accordance with an embodiment of this invention.

Another series of tests both on as-received and heat treated specimens was conducted using a punch radius (114) of 12 mm. The as received, age-hardened 6111-T4 specimens achieved a maximum stretch depth of 70 mm. Thus, it is seen that by doubling the punch radius, an increase in the maximum stretch depth of only three millimeters was obtained. However, when the heat treated specimens at 315°

C. were subjected to the increasingly severe draw operations, a maximum stretch depth of 124 mm was obtained with the higher punch radius. Thus, it is seen that the increase in the punch radius enabled an increase in the depth of the draw of about 75%.

Thus, in accordance with the subject invention, it is seen that workers are now enabled to treat a portion of an age-hardened aluminum alloy sheet material that is to be subjected to a stretch forming operation so as to significantly increase either the maximum stretching operation or improve the quality and uniformity of the stretch formed product. In general, the best results can be determined within the broad range of this invention by trying various heat treat temperatures and various sizes and patterns of the region treated. However, in general principle, the basis of the invention is to selectively heat in that portion of the sheet which is to undergo little or no stretching around the radius of the punch so as to enable the portion that is so drawn around the radius of the punch to be able to draw more of a softened material with it to enhance the quality of the stretch forming operation. The goal of this process is to improve the stretch forming of age-hardened aluminum sheet to produce good parts without tears and excessive thinning.

While the invention has been described in terms of a few specific embodiments thereof, it will be appreciated that other forms of the invention could readily be adapted by those skilled in the art. Accordingly, the scope of the invention is intended to be limited only by the following claims.

I claim:

1. In the process of forming an age-hardened aluminum alloy sheet by clamping edges of said sheet in a fixed position and stretching said sheet with a punch having a sheet forming surface and a punch radius at the periphery of said forming surface such that said sheet is stretched across said forming surface and around said radius and deformed into conformity with said sheet forming surface, the improvement comprising, identifying (a) the edges of said sheet to be clamped and (b) the area of said sheet to be engaged by said punch surface including the portion of said area to be stretched around said punch radius portion, selectively rapidly heating a region within said area of said sheet to be engaged by said punch but excluding from said heated region said portion to be stretched around said punch radius to temporarily eliminate the age-hardened condition of said region and to thereby soften it as compared to the rest of said sheet and immediately quenching said heated region to room temperature and thereafter engaging said sheet with said punch to deform it into conformity with said sheet forming surface before said heated region regains its age-hardened condition.

2. The improvement in the forming of an age-hardened aluminum alloy as recited in claim 1 in which the region of said sheet that is heated includes all of the area to be engaged by the punch but excluding said portion to be stretched around said radius.

3. The improvement in the forming of an age-hardened aluminum alloy as recited in claim 1 in which the region of said sheet that is heated includes less than all of the area to be engaged by the punch excluding said portion to be stretched around said radius.

4. In the process of stretch forming an age-hardened aluminum alloy sheet utilizing a punch and die, said die comprising a die cavity with a die surface for shaping said sheet, a peripheral surface adjacent said cavity for clamping an edge of said sheet and a die radius portion connecting said peripheral surface and said die cavity, said punch having a punch surface complementary to said die cavity surface for engaging a portion of said sheet and a punch radius at the edge of said punch surface, such that said method comprises placing said sheet on the peripheral surface of said die overlying said cavity, fixedly clamping the edges of said sheet against said peripheral surface and engaging said sheet with said punch to stretch the unclamped portion of said sheet into compliance with said die surface; the improvement comprising:

identifying (a) the edges of said sheet to be clamped and (b) the area of said sheet to be engaged by said punch surface including the portion of said area to be stretched around said punch radius portion, selectively rapidly heating a region within said area of said sheet to be engaged by said punch but excluding from said heated region said portion to be stretched around said punch radius to temporarily eliminate the age-hardened condition of said region and to thereby soften it as compared to the rest of said sheet and immediately quenching said heated region to room temperature and thereafter engaging said sheet with said punch to stretch it into compliance with said die before said heated region regains its age-hardened condition.

5. The improvement in the forming of an age-hardened aluminum alloy as recited in claim 2 in which the region of said sheet that is heated includes all of the area to be engaged by the punch excluding said portion to be stretched around said radius.

6. The improvement in the forming of an age-hardened aluminum alloy as recited in claim 2 in which the region of said sheet that is heated includes less than all of the area to be engaged by the punch excluding said portion to be stretched around said radius.

7. The improvement in the forming of an age-hardened aluminum alloy as recited in any one of claims 1–4 in which the thickness of said sheet is in the range of about 0.7 to 1.2 millimeters.

8. The improvement in the forming of an age-hardened aluminum alloy as recited in any one of claims 1–6 in which said alloy is a 6000 series aluminum alloy and initially in a T-4 temper condition.

9. The improvement in the forming of an age-hardened aluminum alloy as recited in any one of claims 1–6 in which said region is platen heated to a temperature in the range of about 250° C. to 530° C. within a period of about ten seconds and immediately quenched.

* * * * *